US005568951A

United States Patent [19]

Morgan

[11] Patent Number: 5,568,951

[45] **Date of Patent: * Oct. 29, 1996**

[54] TAMPER EVIDENT SECURITY DEVICE

[76] Inventor: Brian R. Morgan, 2641 Calle Del Oro, La Jolla, Calif. 92037

[ * ] Notice: The term of this patent shall not extend beyond the expiration date of Pat. No. 5,452,930.

[21] Appl. No.: 401,030

[22] Filed: Mar. 8, 1995

Related U.S. Application Data

[63] Continuation-in-part of Ser. No. 133,556, Oct. 7, 1993, Pat. No. 5,452,930.

[51] Int. Cl.[6] ..... B65D 27/30

[52] U.S. Cl. ..... 292/307 A; 283/98

[58] Field of Search ..... 283/98, 80, 72; 292/307 R, 320, 307 A, 313, 317

[56] References Cited

U.S. PATENT DOCUMENTS

| | | | |
|---|---|---|---|
| 164,800 | 6/1875 | Brooks | 292/307 R |
| 372,653 | 11/1887 | Boughton | 292/307 R |
| 381,326 | 4/1888 | Brooks | 292/307 R |
| 777,749 | 12/1904 | Russel | 292/907 R |
| 822,945 | 6/1906 | Harris | 292/317 |
| 1,615,057 | 1/1927 | Tyden | 292/307 R X |
| 1,814,773 | 7/1931 | Stillman | 292/307 R |
| 1,952,085 | 3/1934 | Mayer | 292/307 R X |
| 2,002,856 | 5/1935 | Hope | 292/307 R X |
| 2,013,299 | 9/1935 | Byrne | 292/307 A |
| 2,497,434 | 2/1950 | Borland | 292/307 R X |
| 4,082,336 | 4/1978 | Natkins | 292/307 R X |
| 4,887,855 | 12/1989 | Tritton | 292/307 R X |
| 5,230,541 | 7/1993 | Nowak | 292/307 R X |

FOREIGN PATENT DOCUMENTS

| | | | |
|---|---|---|---|
| 537425 | 2/1957 | Canada | 292/317 |
| 2306137 | 12/1976 | France | 292/320 |
| 105481 | 9/1899 | Germany | 292/307 R |
| 642806 | 7/1962 | Italy | 292/320 |
| 273289 | 5/1928 | United Kingdom | 292/307 R |
| 342172 | 1/1931 | United Kingdom | 292/307 R |
| 2051942 | 1/1981 | United Kingdom | 292/307 R |
| 2243139 | 10/1991 | United Kingdom | 292/307 R |

*Primary Examiner*—Willmon Fridie, Jr.

*Attorney, Agent, or Firm*—Brown, Martin, Haller & McClain

[57] ABSTRACT

A security tag with an affixed label for deterring tampering or unauthorized opening of a closed container, case or other item to be secured has a base unit and an elongate strap secured at one end to the base unit for extending through eyelets on adjacent parts of the item to be secured, such as one part of a container or case and the closure or lid of the container or case. The base unit has a trapper channel for releasably trapping the free end of the strap. An upper wall of the base unit includes a fixed part and a moveable cover which is hinged to the base unit and moveable between an open position and a closed position preventing removal of the strap from the trapper channel. A label is secured across the fixed part of the upper wall and the closed lid, and a signature is applied to the label. The lid cannot be opened to release the strap without simultaneously tearing the label.

15 Claims, 6 Drawing Sheets

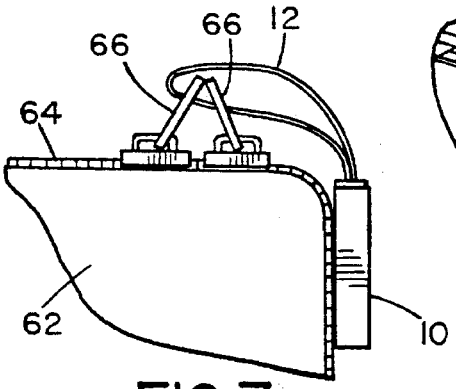
FIG. 7
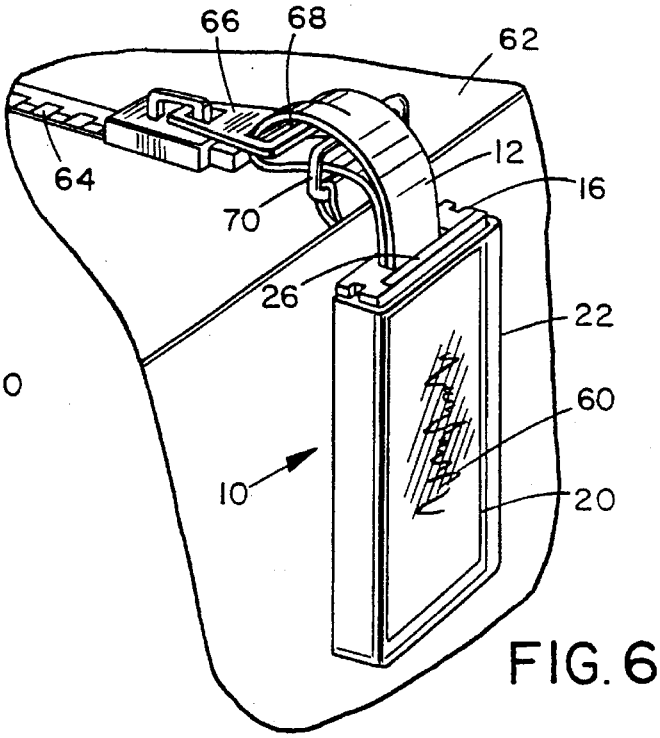
FIG. 6
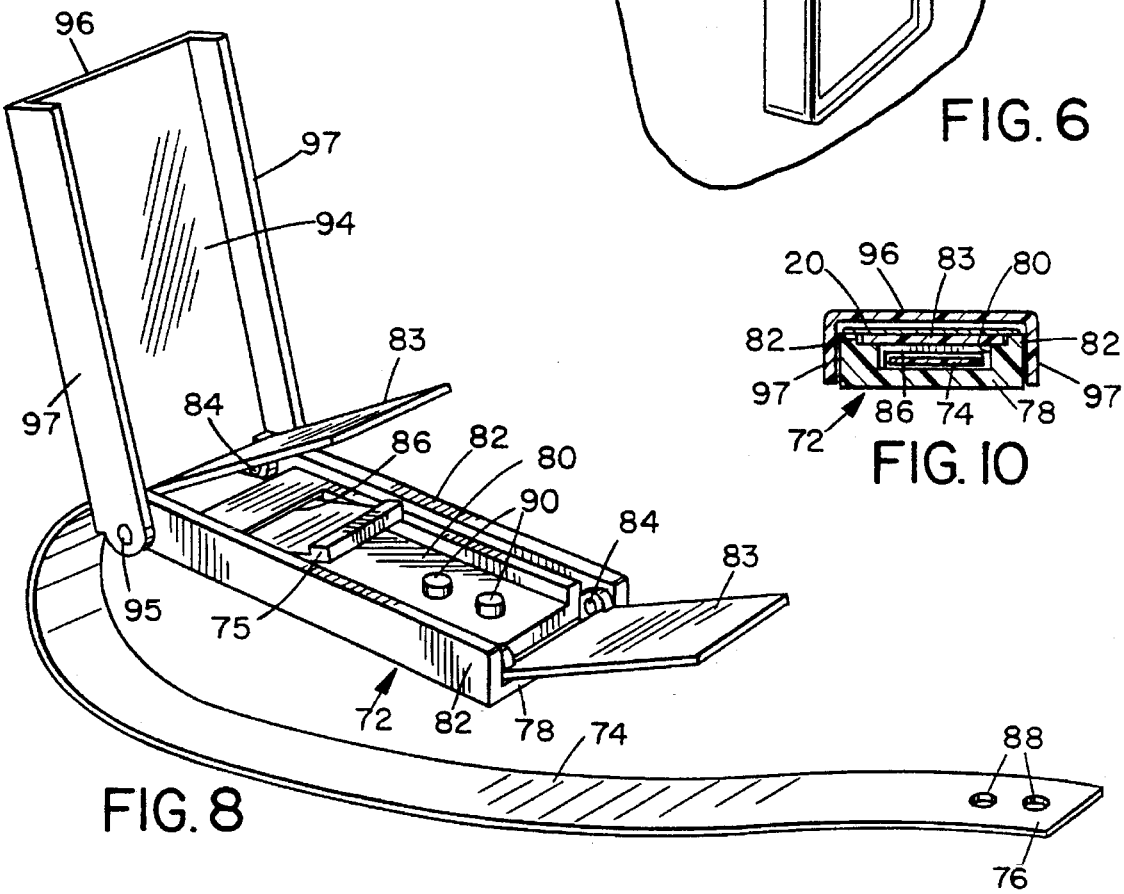
FIG. 8
FIG. 10
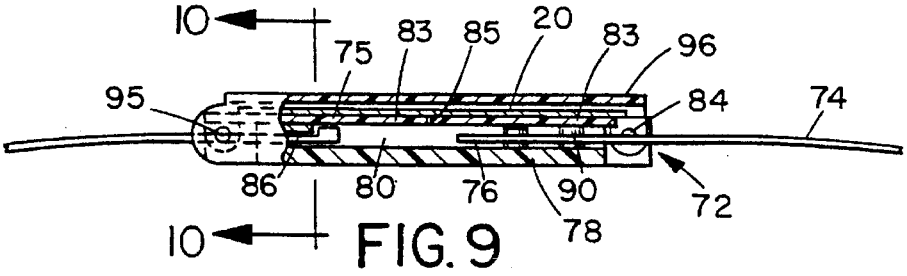
FIG. 9

TAMPER EVIDENT SECURITY DEVICE

CROSS-REFERENCES TO RELATED APPLICATIONS

This application is a continuation-in-part of application Ser. No. 08/133,556 filed Oct. 7, 1993 now U.S. Pat. No. 5,452,930.

BACKGROUND OF THE INVENTION

The present invention relates generally to devices for providing evidence of tampering or opening of various types of containers or enclosures for containing valuables, private materials, or personal items, such as luggage, briefcases, desk drawers, filing cabinets, and so on.

Most security devices or locks for containers, cases and the like have the disadvantage that any unauthorized individual who is able to release the device or lock can re-close it, so that the owner is sometimes unaware that the container has been opened. This is a particular problem for cases, filing cabinets, luggage and the like containing valuable items or secret or sensitive information. There is therefore a need for a security device which provides evidence of tampering when opened by an unauthorized individual.

Simple seals are known for sealing across the closure of a box, folder or container. One such seal is described in U.S. Pat. No. 2,013,299 in which an adhesive backed paper label bearing an authorized signature is adhered across a closure of a container to be protected against access without the owner's knowledge. This is not an ideal solution, since the strip must be removed each time the authorized individual wants to open the container, and new strips must be repeatedly adhered to the surface of the container or case. The strips cannot easily be removed without tearing, and a residue of the paper and adhesive may remain stuck on the container, detracting from its appearance.

SUMMARY OF THE INVENTION

It is an object of the present invention to provide a new and improved tamper evident security device for use with any container or case so as to provide an immediate indication of opening and thus a deterrent to unauthorized opening of the container or case.

According to one aspect of the present invention, a tamper indicating security device is provided, which comprises a base member having a base portion and a cover portion secured to the base portion, a hinge line securing the cover portion to the base portion so that the cover portion can be moved between an open position in which at least part of the base portion is uncovered and a closed position covering the base portion, a securing device for securing the cover portion to the base portion in the closed position, the cover portion having an outer surface which faces outwardly in the closed position and forms at least part of a label-receiving surface for receiving a label, an elongate, flexible member having a first end secured to the base member and a second free end for extending through a loop or tag on at least one part of a container to be protected, and the base member having a device for receiving and trapping the free end of the elongate member in the closed position and releasing the free end in the open position, and the securing device preventing release of the free end without destroying the label.

In one embodiment of the invention, the cover portion extends only over part of the base portion, and the base portion has an outer surface aligned with the outer surface of the cover portion in the closed position. A label for receiving personal indicia is secured across the aligned outer surfaces of the base and cover portions in the closed position, so that the cover portion cannot be opened without tearing across the label. The securing device may be designed to be destroyed on opening the cover portion, so that the security device cannot be reused once opened. It is preferably discarded after one use. Alternatively, the securing device may allow the cover to be opened and closed repeatedly, so that the security device may be reused by attaching a new label. The base member and elongate member are preferably made of a relatively inexpensive material such as plastic.

Eyelets with adhesive backing may be provided for use on cases, containers, files or the like which do not already have such eyelets on the case or zipper, for example. The eyelets may be made of plastic or the like.

The elongate member may comprise a strap secured to the base member at one end and having a series of spaced locking teeth extending from the second end towards the first end along part of the length of the strap, and the device for receiving and trapping the free end comprises a one way locking channel on the base member for receiving the free end of the strap to secure the free end of the strap to the base member, the channel having teeth facing in the opposite direction to the teeth on the strap for permitting the strap to be inserted in a first direction into the channel, the teeth in the channel engaging the teeth on the strap to prevent retraction in a second direction out of the channel.

With this arrangement, the security device can only be removed by breaking or cutting the strap or by opening the cover and thus tearing the label. The label with an authorized signature cannot then be replaced by an unauthorized individual. Thus, opening of a container protected by the security device is immediately apparent.

The security devices of this invention are all relatively inexpensive, and a supply of such devices can easily be carried around or stored for use as needed, for example when travelling. The devices are easy and quick to use.

This arrangement provides an easy and convenient way of preventing others from gaining access to the contents of a container without the owners' knowledge, and will therefore provide a deterrent to anyone attempting to secretly open the container without prior authorization from the owner. The tamper indicating device will be particularly useful when travelling, for example, since it will let the owner know if anyone has opened a suitcase or other case while the case was in transit, or in a hotel room.

The tamper indicating device may be used with any container or item having a movable closure mechanism, including cases, bags, filing cabinets, dressers, cupboards, rooms, and even books. In the case of a room or cupboard, a door may be held closed by attaching an eyelet to the door frame and a second eyelet or the base unit to the door. The strap or elongate member may then be extended through the or each eyelet and secured to the base unit, thus preventing opening of the item or area without the user's knowledge.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which:

FIG. 6 illustrates the tamper indicator securing a zipper;

FIG. 7 illustrates the tamper indicator securing two adjacent zipper pull tabs;

FIG. 8 is a perspective view of an alternative tamper indicator in an open position;

FIG. 9 is a side elevation view, partially cut away, of the structure of FIG. 8 in a closed and sealed position;

FIG. 10 is a sectional view taken on line 10—10 of FIG. 9;

FIG. 21 is a view similar to FIG. 20 illustrating the device in a closed position as used for securing a container or the like;

DESCRIPTION OF THE PREFERRED EMBODIMENT

Figure 1:
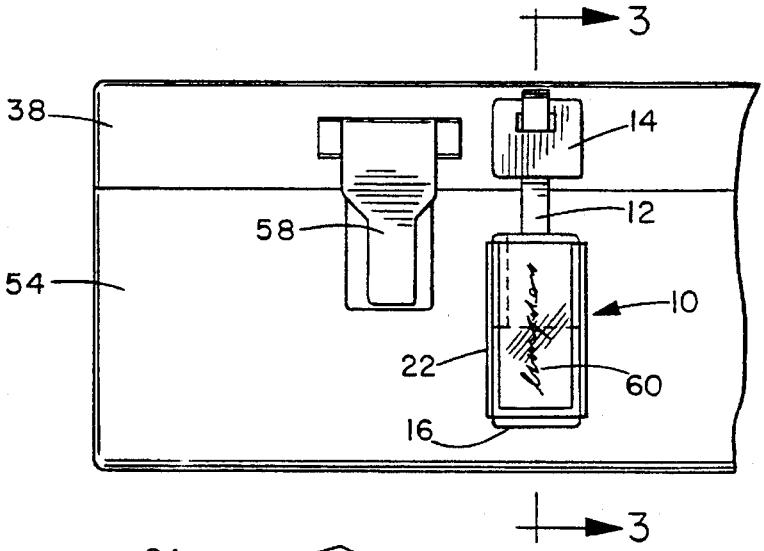
FIG. 1 is a front view of a portion of a briefcase or the like with the tamper indicator according to a first embodiment of the invention attached.
Figure 2:
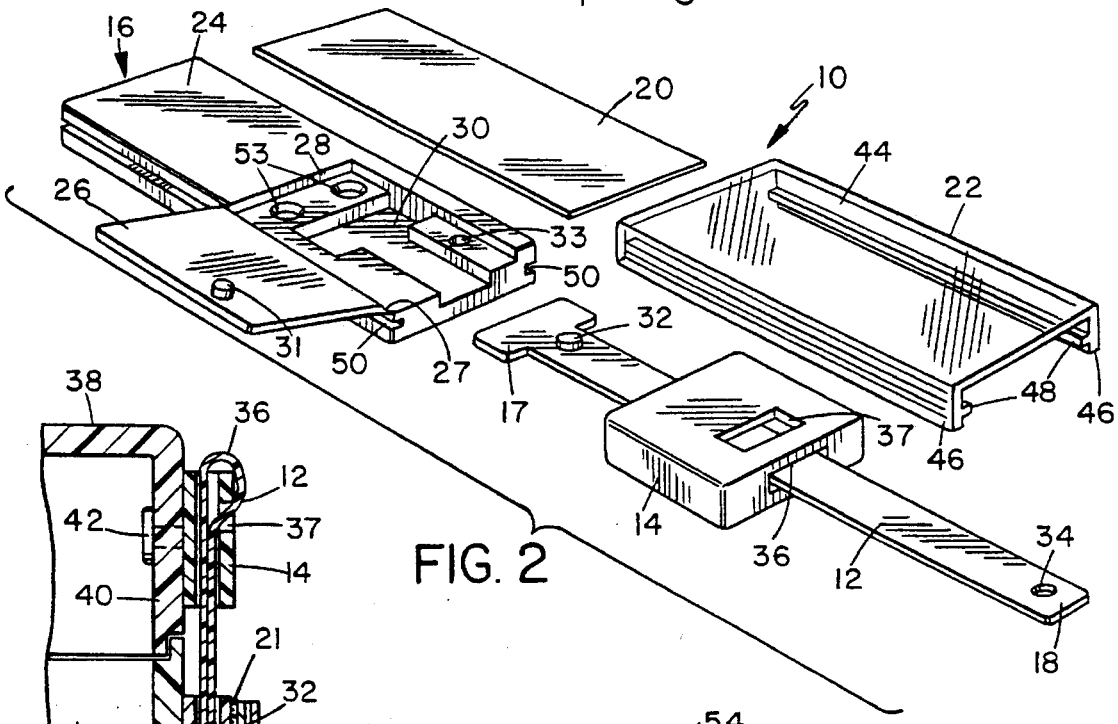
FIG. 2 is an exploded view of the components of the tamper indicator.

FIG. 2 of the drawings illustrates a tamper indicator 10 according to a first embodiment of the invention, while FIGS. 1, 3 and 4 and FIG. 5 illustrate two alternative ways of using the indicator 10.

The tamper indicator 10 of FIG. 2 basically comprises a security strap 12, a channel unit or eyelet 14 through which the strap 12 extends, and a base unit 16 for trapping the ends 17,18 of the strap 12. The indicator 10 also includes a supply of labels 20 of the type described in my co-pending application Ser. No. 07/930,731 referred to above, the contents of which are incorporated herein by reference, and a removable transparent cover 22 for the base unit 16. Only one of the labels 20 is illustrated in FIG. 2, but it will be understood that a supply of blank labels will be provided with the other components of the tamper indicator. Each label has a contact adhesive backing layer 21 which will be covered by a peel-off layer (not illustrated) prior to use.

The base unit 16 has a flat top wall 24 including a movable lid or cover portion 26 which is hinged along one edge 27 to the remainder of the unit 16 and separated from the remainder of wall 24 along dividing line 28. Movable cover portion 26 is illustrated in an open position in FIG. 2, revealing a T-shaped recess 30 in the base unit for receiving the correspondingly T-shaped end 17 of strap 12. Thus, movable cover portion 26 provides access to recess 30. The cover portion or lid 26 has a suitable strap fastener mechanism, such as snap button 31, for releasable snap engagement with a mating fastener, such as snap opening 33 to receive button 31 on the edge of recess 30.

Figure 3:
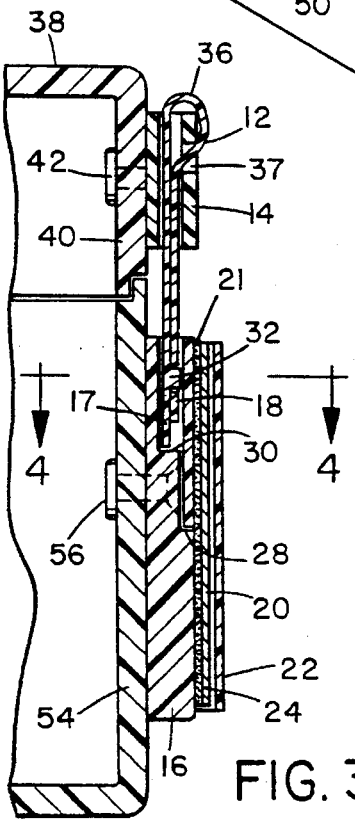
FIG. 3 is an enlarged sectional view taken on line 3—3 of FIG. 1.

End 17 of strap 12 has an upstanding boss or pin 32 and the opposite end 18 of the strap has an opening 34 for engagement over pin 32 so that both ends of the strap can be held together in the recess 30 when the portion 26 is snapped closed, as illustrated in FIG. 3. When portion 26 is closed, it forms a flat surface with the remainder of wall 24 for receiving the label 20, which may be secured across wall 24 including the closed cover portion 26 via the adhesive backing layer of the label.

The channel unit 14 comprises a block having a through bore or channel 36 through which the belt 12 can be threaded, and is adapted for mounting on one part of a case or other container such as the lid 38 of a suitcase or briefcase, for example, as illustrated in FIGS. 1 and 3. Unit 14 has a slot 37 on its upper wall for doubling the belt back through channel 36, as illustrated in FIGS. 1 and 3. The unit 14 is secured to the downwardly depending rim 40 of the lid 38 via screws or rivets 42, as best illustrated in FIG. 3. Unit 14 may alternatively comprise a ring or loop member through which the belt can be threaded, in other arrangements. A zipper opening, ring or loop already provided on a case may be used in place of unit 14, if present.

The cover 22 is of transparent material and has a flat upper surface 44 and downwardly depending side rims 46 extending along opposite side edges of surface 44. Rims 46 have ribs 48 on their inner faces for sliding engagement in grooves 50 provided in the opposite side edges 52 of the base unit 16. The cover 22 may alternatively be hinged at one end or side to the base and be designed for snap engagement over the base unit 16.

Figure 4:
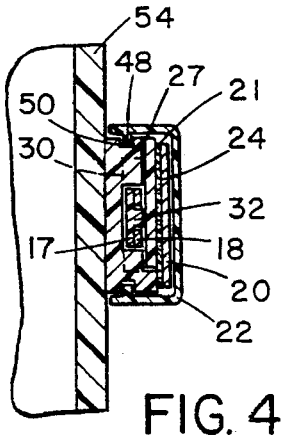
FIG. 4 is a sectional view taken on line 4—4 of FIG. 3.

The base unit 16 preferably has openings or holes 53 in its part which is normally covered by movable cover 26 and can be mounted on the other part of a case, such as on the side wall 54 of the base of a suitcase as illustrated in FIGS. 1, 3 and 4, via rivets 56 extending through openings 53 and corresponding openings provided on the side wall of the case. The base unit is mounted on the base in alignment with the channel unit 14, as illustrated in FIG. 1.

The base unit and channel or loop unit can be made of any suitable material such as plastic or metal which may match the latches 58 of the suitcase or briefcase, while the strap is of any suitably strong material which can be customized in length by the user. Thus, strap end 18 may be provided with a series of spaced holes 34 so that the length can be adjusted while still leaving a hole for snap engagement over pin 32. Where base unit 16 is of plastic, hinge 27 is formed integrally by a thin web of plastic along the length of movable cover portion 26. If the base unit is of metal, a two-part hinge will be used. Once the base and channel units have been mounted as illustrated in FIG. 1, the tamper indicator is ready to use.

When a suitcase or briefcase owner wants to secure the contents of the suitcase or other case, for example when the case is in transit or left in a hotel room or elsewhere, they first thread one end of the belt through the channel unit 14. The ends are then trapped in recess 30, and the cover 26 is snapped closed over the trapped ends. At this point, label 20 is adhesively secured across the closed cover 26 and the remainder of the top wall 24 of the unit, effectively securing cover 26 in its closed position where the belt ends are trapped. The owner then applies personal indicia such as a signature 60 to the label. Transparent cover 22 is then engaged on the base unit 16 to cover and protect the label, leaving the signature 60 visible, as illustrated in FIG. 1.

Once the tamper indicator 10 has been set up as illustrated in FIGS. 1, 3 and 4, no one can open the case without first releasing strap 12 from the base unit 16, or else cutting the strap. In the latter case, tampering will be immediately evident. In the former case, tampering will also be evident since the only way in which the strap ends 17,18 can be released from the trapping device (recess 30 and cover portion 26) is by opening the cover portion 26. Since cover portion is secured closed by the label 20, it cannot open without first tearing off or destroying label 20. The adhesive backing of label 20 will be such that the label 20 cannot be pulled up and subsequently reapplied. Thus the adhesive is strong enough to adhere firmly to the underlying surface so that it cannot be peeled off in one piece without tearing the label. In the unlikely event that the label is peeled off in one piece, the adhesive backing will be damaged, making it impossible to stick the label back down properly after opening the case. The person opening or tampering with the case will not be able to replace label 20 with a new label after opening the case, since he or she will not be able to duplicate the owner's signature 26. Thus, the tampering will be immediately evident to the owner when he or she sees the torn or forged label through the tamper indicator 10.

This system will be particularly useful when travelling, for example, since owners will be able to tell immediately whether their cases have been opened in transit. Also, it can be used whenever a case is left somewhere, such as a hotel room, and the owner wishes to protect the case contents. It will deter unauthorized opening of cases and other containers since individuals will be less likely to open the case or container when they realize that they cannot conceal the fact that the case has been opened. This is particularly true where only certain individuals would have had access to a case or container, such as when a suitcase is in transit on an airline, for example.

Figure 5:
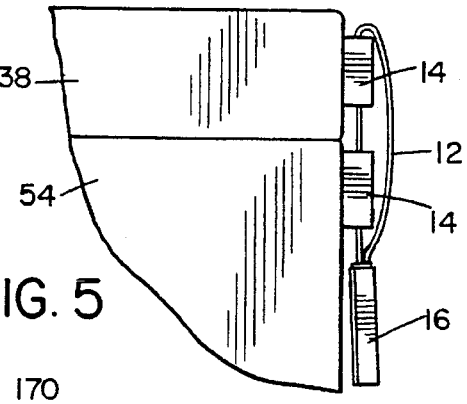
FIG. 5 sectional view illustrating a modified arrangement of the tamper indicator using two eyelet units with the base unit hanging free.

FIG. 5 illustrates a modification of the tamper indicator of FIG. 2, in which two loop or channel units 14 are used instead of one, allowing the base unit 16 to hang free, supported by the strap. In this arrangement, one channel unit 14 is secured to one side of a closure, such as the lid 38 of a case, while the other channel unit 14 is secured to the other side, such as the body or base of a suitcase or other type of case. The strap 12 is then extended through both units 14 and the strap ends trapped in base unit 16 exactly as described above in connection with FIGS. 1–4. The base unit therefore hangs free in this case, suspended by strap 12, and the strap length is such that the case cannot be opened without releasing the strap ends, in turn destroying the personalized tamper indicating label.

The tamper indicator can be installed readily on any type of case or container on assembly, or may be retro-fitted on any type of case. It may also be used on other containers or enclosures for holding sensitive, private or valuable items, such as dresser drawers, filing cabinets, jewelry boxes, cupboards, diaries, books, supply room doors and the like. All that is necessary is that a loop or channel unit be secured to one or both sides of a closure, lid, panel or door of an item or enclosure and the base unit either be secured to the other side or hanging free if two loops or channel units are used, as in FIG. 5, so that the belt extends across an edge of the closure when trapped.

When used on furniture, such as a desk drawer, channel units 14 may be secured on the inside of the drawer frame and drawer, respectively, so as not to detract from the external appearance of the furniture. Strap 12 can be pulled through units 14 with the drawer open, and the drawer is then closed so that the ends hang free on the outside of the drawer. End 18 is then customized in length and trapped with end 17 in base unit 16, so that the drawer cannot be opened without releasing the strap ends from the base unit.

The tamper indicator 10 may also readily be used on any type of case or container having a zipper fastener, without needing the channel member 14 or any mounting of the base unit on the case or container, as illustrated in FIGS. 6 and 7. FIG. 6 illustrates a case 62 having a zipper fastener 64 with a pull tab 66 having a conventional eyelet 68. As is conventional on some cases with this type of fastener, a ring or eyelet 70 is provided at the closed end of the fastener 64 for securing to the pull tab eyelet 68 via a conventional padlock, for example, in order to lock the case. Such fasteners are provided, for example, on some types of suitcases, suit bags, sports bags, rucksacks, and many other types of bags.

The tamper indicator 10 may easily be used on any type of bag having a zipper fastener 64 of the type illustrated in FIG. 6, simply by threading strap 12 through the zipper tab eyelet 68 and end ring 70, and then trapping the ends 17,18 in the base unit 16 in the same way as illustrated in FIGS. 3 and 4. The cover portion 26 of the top wall 24 is then closed over the trapped strap ends, and a label 20 is adhered across cover portion 26 and the remainder of the wall 24. The user then applies signature 60 and engages transparent cover 22 over the base unit to cover the label. Thus, this does not require any retro-fitting or mounting on the case itself, and provides a very convenient means for deterring unauthorized opening of the case.

Whenever the owner wishes to open the case, they simply tear off label 20 and release the strap. The strap ends are again threaded through eyelet 68 and end ring 70 when the case is re-closed, and trapped in the base unit before applying a new label. The owner will have a supply of labels 20 for convenient use each time the case is opened FIG. 7 illustrates another conventional zipper fastener 64 in which two zipper pull tabs 66 are provided and are pulled together in order to close the zipper. When the zipper is closed, the pull tabs will meet. The strap 12 can then be threaded through the eyelets of both pull tabs and then trapped in the base unit 16. The zipper pull tabs cannot then be pulled apart to open the case or bag without releasing the strap.

FIGS. 8–10 illustrate a base unit 72 and strap 74 of a modified tamper indicator according to another embodiment of the invention. The base unit 72 and strap 74 may be used with one or two channel units 14 of the previous embodiment on cases having non-zipper closures, and may be used in an equivalent manner to that illustrated in FIG. 6 or 7 on any case having a zipper fastener.

In the embodiment of FIGS. 8–10, instead of releasably trapping both ends 75,76 of the strap 74 in the base unit 72, one end 75 is permanently secured to the base unit. Base unit 72 has a lower wall 78 with a recess 80 and spaced side walls 82. A pair of pivotally mounted end flaps 83 form an upper wall of the base unit 72 covering recess 80 when in the closed position illustrated in FIGS. 9 and 10. Each flap 83 is pivotally mounted at a respective end of the base unit via pivots 84 in side walls 82, and the flaps meet along dividing line 85 when closed to form a flat, continuous top wall of the base unit, with each flap forming half of the top wall.

Strap 74 has an enlarged portion at end 75 which is trapped in the recess 80 while the strap extends through an opening 86 in one end of the base unit. The opposite end 76 of the strap has a pair of openings 88 designed to engage over bosses or pins 90 provided in recess 80 when the end 76 is threaded through the opposite end of the base unit and into the recess.

A transparent lid or cover 94 is pivoted at one end to the base unit via pivots 95 for movement between the open position illustrated in FIG. 8 and the closed position in which it extends over the top of the base unit as illustrated in FIGS. 9 and 10. The cover 94 has an upper wall 96 and downwardly depending side rims 97 for fitting over the top and sides of the base unit.

In order to use the tamper indicator of FIGS. 8–10 on a case or other enclosure which does not have a zipper fastener, for example a case with latches as illustrated in FIG. 1, two channel units 14 are first attached to two parts of the case or enclosure as illustrated in FIG. 5. The free end 76 of the strap 74 is then threaded through the bore 36 in each channel unit 14, and then threaded into the base unit recess 80. With flaps 83 in the open position, the holes 88 are placed over bosses 90. The flaps are then closed to trap the strap end 76, and a tamper indicating label 20 is adhered to the closed top wall so as to extend over both flaps, as illustrated in FIGS. 9 and 10. The user then writes their signature on top of the label and closes cover 94. The base unit is then hanging free as in FIG. 5. The strap is then secured across a closure line of the case to prevent opening of the case without first releasing the strap and thus damaging or destroying the label.

In order to use the tamper indicator with a case having a zipper fastener, the owner simply threads the end 76 of the strap 74 through a zipper tab eyelet 68 and end lock ring 70, or two adjoining zippers as in FIG. 7, engages end 76 on the bosses in recess 80, and then closes the flaps to trap the strap end. Again, a personalized security label 20 is applied over the closed flaps to secure them closed, and the owner writes a signature on the label before closing cover 94.

The flaps 83 may also have snap fasteners for snap engagement with mating fasteners on the lower wall, as in the first embodiment. This will hold the flaps closed even if the strap becomes dislodged for some reason, preventing inadvertent damage to the label when simply moving the case, for example. In this case, the label secures the flaps but does not hold them closed, since the snap fastener mechanism will hold the flaps closed.

In either case, no one will be able to open the case without first tearing the label 20 to allow the flaps 83 to be opened so that the strap end 76 can be released. This will make the tampering immediately evident to the owner of the case on their return, and will therefore provide a deterrent to unauthorized opening of the case and tampering with its contents, particularly in situations where only certain identifiable individuals would have had access to the case.

Figure 11:
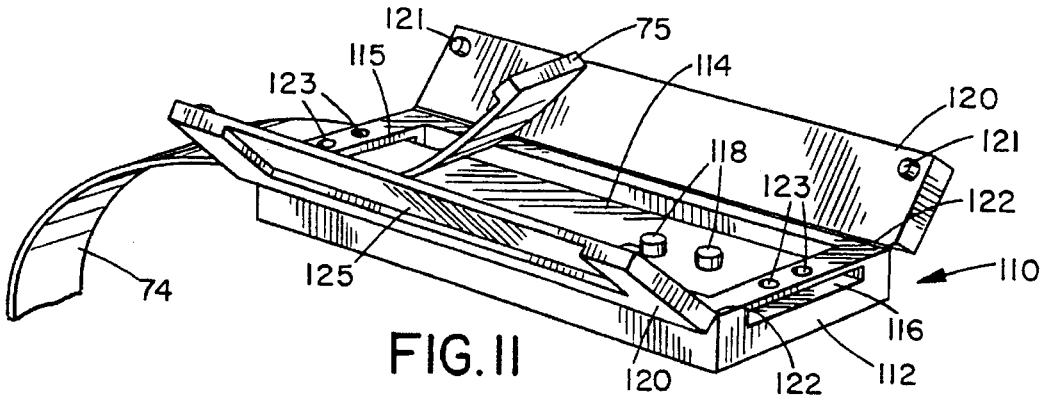
FIG. 11 is a perspective view of a further configuration of the tamper indicator.
Figure 12:
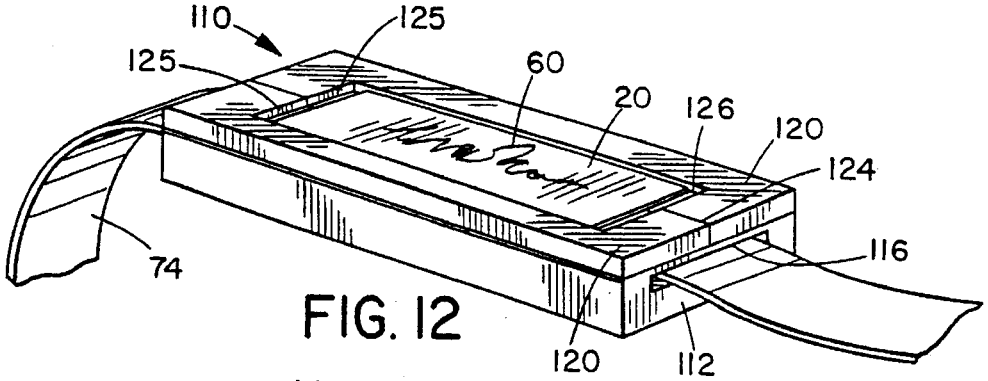
FIG. 12 illustrates the structure of FIG. 11 in a closed and sealed position.

Another modified base unit 110 for a tamper indicator is illustrated in FIGS. 11 and 12. This is similar to that of FIGS. 8–10 and uses an identical strap 74 with enlarged end portion 75 and a pair of openings 88 (not visible in the drawings) in the opposite end of the strap. Base unit 110 has a lower wall 112 with a recess 114, and openings 115, 116 at opposite ends of the recess through which strap 74 can be threaded. The strap is threaded through one end opening 115 with the enlarged end 75 trapped in the recess, as indicated in FIG. 11, while the opposite end is free for threading through a ring or channel unit on a case. A pair of pins or bosses 118 are provided in the recess 114 for engagement with the openings 88 on the strap 74.

A pair of side flaps 120 are hinged along hinge lines 122 on opposite sides of the lower wall 112 and may be closed to form a continuous top wall of the base unit covering the recess 114, as illustrated in FIG. 12. When closed, the side flaps meet along dividing line 124 extending longitudinally along the length of the base unit, unlike dividing line 85 of the previous embodiment which extended transversely across the top of the base unit. Each side flap 120 has a recessed rectangular portion 125 which cooperates with the recessed portion 125 on the other side flap when the flaps are closed to form a flat recessed area 126 of dimensions slightly larger than that of a label 20, as illustrated in FIG. 12. The side flaps preferably have snap buttons 121 for snap engagement in snap recesses or holes 123 on lower wall 112, illustrated in FIG. 11. This snap closure will hold the flaps closed over the trapped strap end.

The tamper indicator of FIGS. 11 and 12 may be used in an equivalent manner to those of the previous embodiments, either in conjunction with one or two channel units 14 or with a zipper pull tab and lock ring, or two zipper pull tabs, or with any ring or loop already provided on a case or container. Again, the free end 76 of the strap 74 is threaded through channel member 14, or through zipper end tab and lock ring in a case having a zipper fastener or where two zippers zip to meet one another as illustrated in FIG. 7. End 76 is then threaded through end opening 116 into recess 114, and the openings 88 are engaged over bosses 118 with the side flaps 120 open. Side flaps 120 are then snapped closed, and a label 20 is adhered to the flat recessed area 126 to secure the flaps. A signature 60 is then applied to the label 20. The transparent cover of the previous embodiments is not essential in this case since the label is recessed and therefore less liable to be damaged, although a cover 22 or 94 as in either of the previous embodiments may be provided for use on the base unit if desired for additional protection.

Again, once the strap end 76 is trapped and the label 20 is applied as in FIG. 12, the end 76 can not be released without first tearing the label 20 or at least destroying its adhesive backing. Thus, the owner of the case is provided with an immediate indication of whether the case has been tampered with in their absence.

Figure 13:
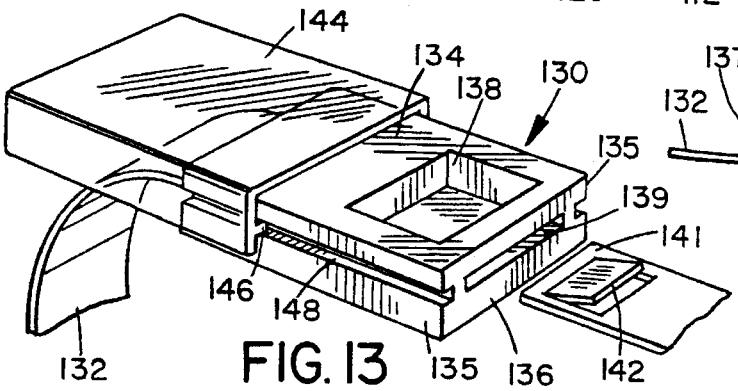
FIG. 13 is a perspective view of another configuration of the tamper indicator.
Figure 14:
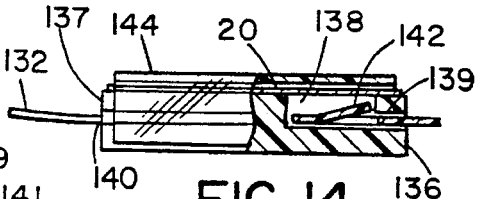
FIG. 14 is a side elevation view, partially cut away, of the structure of FIG. 13 in closed and sealed position.

FIGS. 13 and 14 illustrate another modified base unit 130 and retaining strap 132 which may used in the manner illustrated in FIGS. 1, 3 and 4, 5, 6 or 7, depending on the type of case or container closure. In this embodiment, base unit 130 is a rectangular block having an upper surface 134, side walls 135, and end walls 136,137. A recess 138 is provided in the upper surface, and end wall 136 has an opening 139 leading into recess 138. One end 140 of the strap 132 is permanently secured to the opposite end wall 137 in any suitable manner, such as adhesive, riveting, or other types of fasteners.

The opposite end 141 of the strap has an upstanding snap lug 142 and is designed to be inserted through the opening 139 into recess 138, with the snap lug first being depressed and then snapping up when it is fully inserted to hold the strap end in the recess, as illustrated in FIG. 12. The snap lug 142 must then be depressed by pushing down on it through the open top of the recess 138 in order to release the strap end. The open top of the recess is therefore covered by a label 20 in order to provide the tamper protection of this device, as indicated in FIG. 12. Label 20 extends across the entire upper surface of the base unit. A slide-on or snap-on cover 144 is provided for covering and protecting label 20. Cover 144 as illustrated is similar to that of the first embodiment and has side ribs 146 for sliding engagement in grooves 148 provided along the side walls 135 of the base unit. Alternatively, a snap-on transparent cover as in FIG. 8 may be used.

It will be understood that the strap and base unit of this embodiment may be used either in the manner illustrated in FIGS. 1, 3 and 4 or FIG. 5 above, in conjunction with one or two suitable channel units 14 or other rings or loops on a case, or in the manner illustrated in FIG. 6 or 7. The free end 141 of the strap is threaded through channel unit 14 or any other suitable loop or ring member on one part of a case, or through a zipper end tab and lock ring or two adjoining zippers, and is then snapped into recess 138 of base unit. Label 20 is then adhered to upper surface 134 across recess 138. A signature 60 may be applied to the label prior to adhering it to the base unit. The cover 144 is then moved over the base and attached label, as illustrated in FIG. 14, in order to protect the label against accidental damage. The base unit is then held by the straps and will hang free.

With this arrangement, the snap fastener cannot be released without tearing or removing label 20, which will then be impossible to reapply and will provide immediate evidence that the device has been tampered with in order to gain access to the case. Although in this embodiment the recess is not provided with a lid or cover flap, as in the previous embodiments, a transparent hinged lid or cover flap may be provided over recess 138 if desired.

Figure 15:
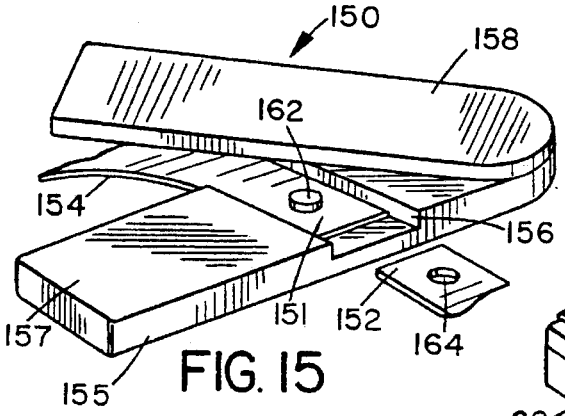
FIG. 15 is a perspective view of a further configuration of the tamper indicator in an open position.
Figure 16:
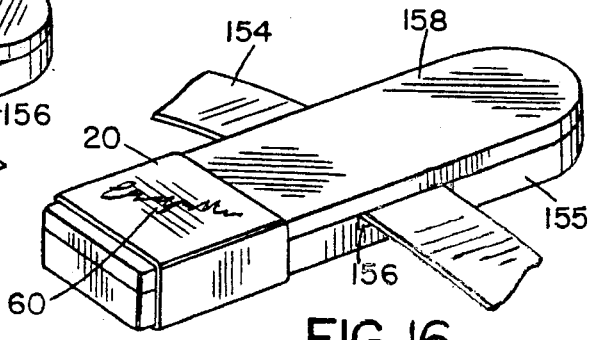
FIG. 16 illustrates the structure of FIG. 15 in a closed and sealed position.

FIGS. 15 and 16 illustrate a base unit 150 and opposite ends 151,152 of a retaining strap 154 according to another embodiment of the invention. In this embodiment, the base unit 150 has a lower wall 155 having a transverse recess 156, and an upper wall 158 which is pivoted to the lower wall 155 at one end of the base unit about a vertical pivot axis. Instead of pivoting upwardly as in the case of the cover flaps and portions of the previous embodiments, upper wall 158 is pivotally attached so as to pivot or swing sideways about one end of the base unit between the open position of FIG. 13 and the closed position of FIG. 14. In the closed position, upper wall 158 completely covers the recess 156.

Recess 156 has an upstanding boss or pin 162, and each end of the strap has a corresponding opening 164 for engaging over pin 162 with the upper wall 158 in the open position. The upper wall 158 can then be closed to trap the strap ends in the recess. A label 20 is then wrapped transversely around the free end of the upper wall and the underlying end of the lower wall, securing the upper wall in its closed position and preventing opening of the upper wall without destroying or tearing the label. The user can write a signature 60 across the label before wrapping it around the base unit, providing an effective tamper indicator.

The base unit and strap may be used in an equivalent manner to the previous embodiments, by extending the strap through suitable channel units or other rings or loops secured to each opening part of the case, for example, and trapping the strap end or ends in the base unit as described above. The base unit will then hang freely on the straps. It may also be used as in FIG. 6 or 7 with any case, bag or container having a zipper fastener, and the base unit will again hang freely from the case, suspended by the strap. Instead of threading the strap through the rings, loops or channel units on the case, one end of the strap may instead be secured to one part of the case while the other end is releasably trapped in the base on another part of the case or container, with the strap extending across a closure line of the case or container and thus preventing opening of the container without releasing the trapped end of the strap. Once the tamper indicating label has been applied and personalized, the case or container cannot be opened without first releasing the strap from the base unit, and this cannot be achieved without tearing or destroying the label, making the tampering immediately evident to the owner.

Figure 17:
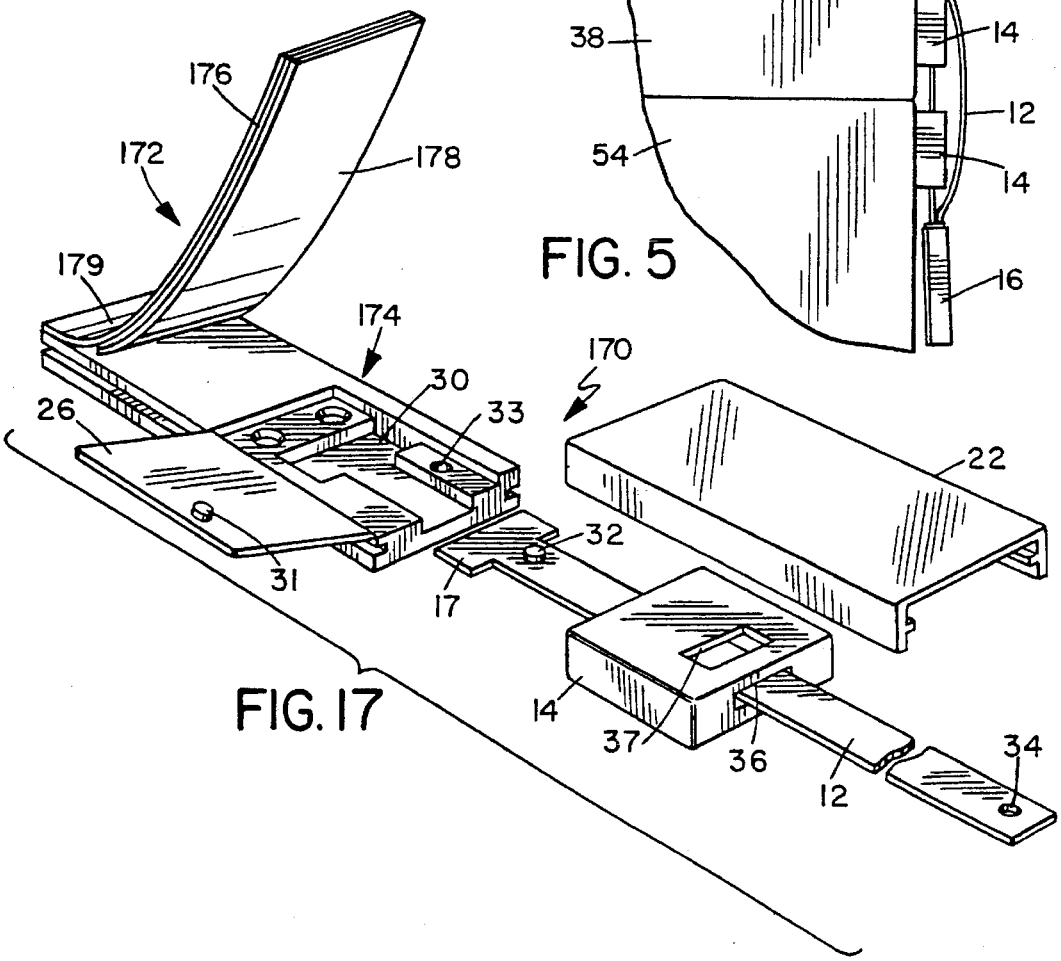
FIG. 17 is an exploded view of the components of an alternative embodiment of the tamper indicator.

FIG. 17 illustrates a tamper indicator 170 according to another embodiment of the invention in which the separate paper labels 20 of the previous embodiments are eliminated, and replaced with a reusable tamper indicating label 172 permanently secured to base unit 174. The other parts of tamper indicator 170 are identical to those of FIG. 2, and like reference numerals have been used as appropriate for like parts.

Base unit 174 is similar to the base unit 16 of the first embodiment and like reference numerals have been used for like parts. However, reusable tamper indicating label 172 is secured at one end to one end of the upper wall 24 of base unit 174. Label 172 is of length equivalent to that of base unit 174, and comprises a multi-layer strip having a base or host layer 178 carrying a coating 176 of imprinting medium such as grease, ink or the like, and an upper transparent or translucent layer 179. This is equivalent to the tamper indicating label as described in my co-pending application Ser. No. 07/946,183 filed Sep. 16, 1992, the contents of which are incorporated herein by reference. Thus, if the cover portion 26 of base unit 174 is snapped closed over the trapped ends of strap 12, and label 172 is laid flat over the top of wall 24, the user can apply personalized indicia to the label by applying pressure to upper layer 179 with a pencil stylus or other tip. This produces a temporary bond between the grease and the upper layer at the location of pressure application, in the manner of a so-called "grease pencil" pad. The user can therefore "write" a temporary signature onto the label 172.

This device is used in exactly the same way as the tamper indicators of the previous embodiments up to the point at which the indicator label is applied to the base unit. Thus, it may be used in the manner illustrated in FIGS. 1, 3 and 4, FIG. 5, FIG. 6 or FIG. 7 to secure a container or item closed. Once the cover portion 26 is snapped closed over the trapped strap ends, the user imprints a signature onto the label 172, and closes the transparent cover 22 over the label and base. The signature will remain undisturbed as long as the cover is in place. However, if anyone removes the cover in order to open the case, the label will be disturbed and the layers will tend to separate, partially or completely obliterating the signature.

Figure 18:
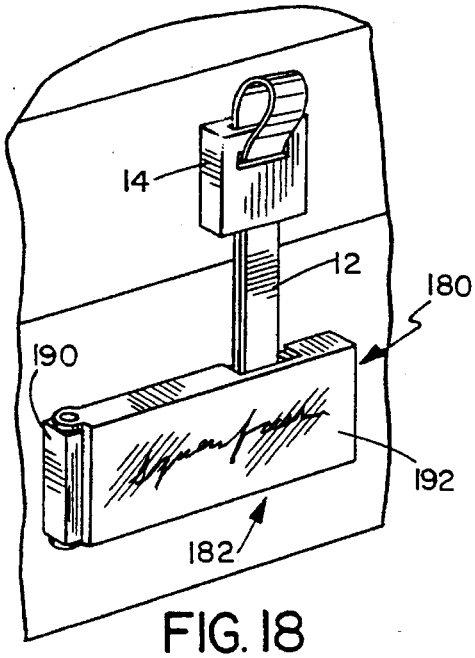
FIG. 18 is a front view of a portion of a briefcase with a tamper indicator according to another embodiment of the invention.
Figure 19:
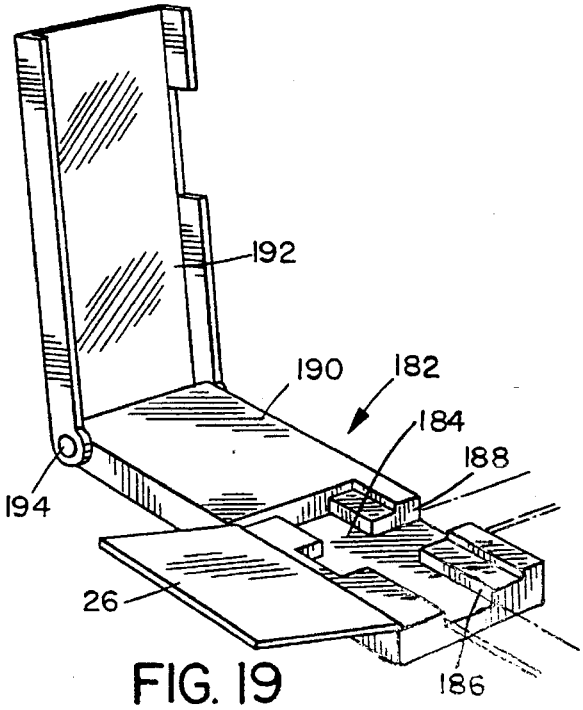
FIG. 19 is a perspective view of the tamper indicator of FIG. 18 in an open position.
Figure 20:
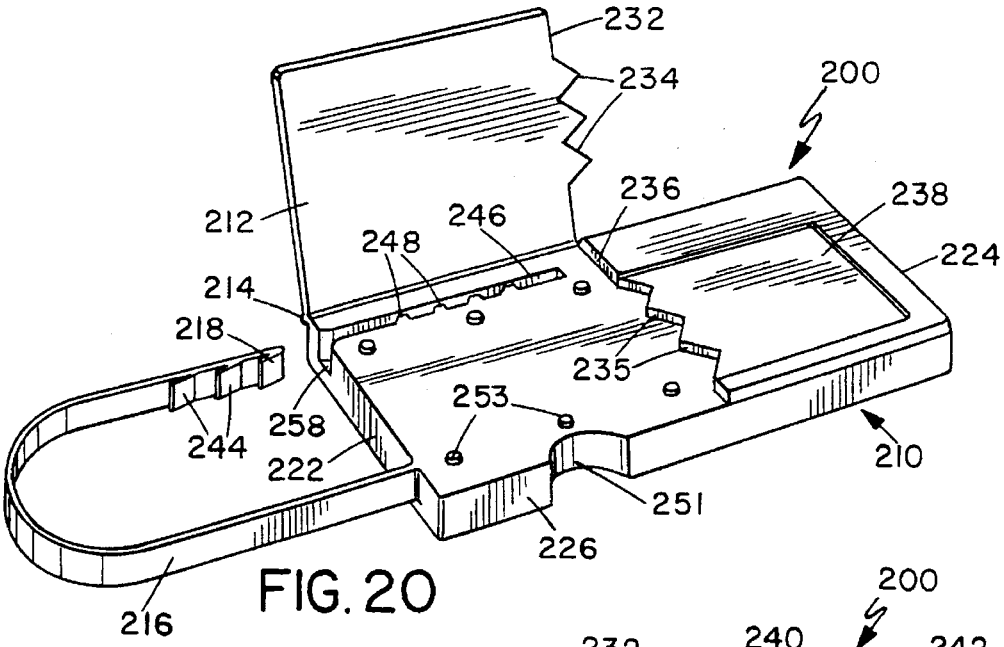
FIG. 20 is a perspective view of a tamper indicating device according to another embodiment of the invention in an open position.

FIGS. 18 and 19 illustrate a modified tamper indicator 180 which is similar to that of FIG. 2 but which is modified to allow the strap ends to be secured endwise or transversely to the base unit. Portions of the tamper indicator 180 of FIGS. 18 and 19 are identical to that of FIG. 2, and like reference numerals have been used for like parts as appropriate. Thus, tamper indicator 180 comprises one or more channel units 14, a strap 12, and a modified base unit 182. Base unit 182 is similar to base unit 16 of FIG. 2 apart from the recess 184 which is of a different shape to recess 30 of FIG. 2, and like reference numerals have been used for like parts when appropriate. However, instead of recess 30 having a T-shape with a stem directed through one end of the base unit, as in FIG. 2, recess 184 has two perpendicular, superimposed T-shaped areas, one of which has a stem portion 186 extending out through one end of the base unit, and the other of which has a stem portion 188 extending out through one side 190 of the base unit. Thus, the T-shaped end of the belt can be placed into one T-shaped area to extend out endwise from one end of the base unit, or into the perpendicular T-shaped area and stem portion 188 to extend out from the side of the base unit, as illustrated in FIG. 18. Additionally, instead of slide-on cover 22 as in FIG. 2, the base unit has a transparent cover 192 hinged via hinges 194 at one end of the base unit for closing over the base unit and label.

The tamper indicator as described in any of the above embodiments can be used on any type of case, box or other container or enclosure for restricting access to the contents of the item or container and providing an immediate indication of any unauthorized access. Although use of the indicator on cases such as suitcases, briefcases and other bags is described above, it will be understood that it may also be used on boxes, pieces of furniture such as filing cabinets, chests of drawers, cupboards, books and folders, or the like, and any other item having a movable closure.

In order to use the device to indicate opening of a drawer, for example, all that is necessary is that the base be applied to any rigid surface adjacent the drawer or opening, and the strap be looped through the drawer or door handle, or a channel unit applied to the drawer or door, and then trapped in the base unit. Alternatively, two loops or channels may be applied, one to the drawer and one to any adjacent surface, and the strap may then be looped through both channel units and trapped in the base unit which will hang free. A personalized label is then applied to the base unit. The drawer or door cannot be opened without first releasing the strap end or ends from the base unit, which will in turn require removal and tearing of the label. It will be understood that the flat strap of the illustrated embodiments may be replaced by any type of elongate connecting member, such as a line, chain, or the like.

In order to use the device on a book, diary, folder or the like, a base unit or loop is applied to one cover and a second loop or channel unit is applied to the other cover. The strap can then be extended through the loops or each channel unit, across the closure opening and trapped in the base unit before applying the tamper indicating strip or label.

Such tamper indicators may be provided as accessories for use with bags or cases with zipper fasteners, and may be easily mounted on cases or containers which do not have zipper fasteners, as described above in connection with FIGS. 1, 3 and 4. New cases may be manufactured with tamper indicators matching the other fittings on the case, and tamper indicators can be readily retro-fitted on existing cases. Other information can be imprinted on the base unit, such as the owner's name and address. This provides owners with an easy method of deterring unauthorized opening of their cases or other containers, since such opening will be immediately apparent from the state of the tamper indicator. The system is particularly useful where only a few, easily identifiable individuals have access to an unattended bag, container or other item.

FIGS. 20–23 illustrate a tamper indicating or security device or label 200 according to another embodiment of the invention. The device 200 basically comprises a base member or unit 210 of injection molded plastic material or the like having a lid or cover portion 212 hinged to the base unit 210 along a living hinge 214, and a strap or tongue 216 secured to the base portion at one end and having an opposite free end 218.

Figure 21:
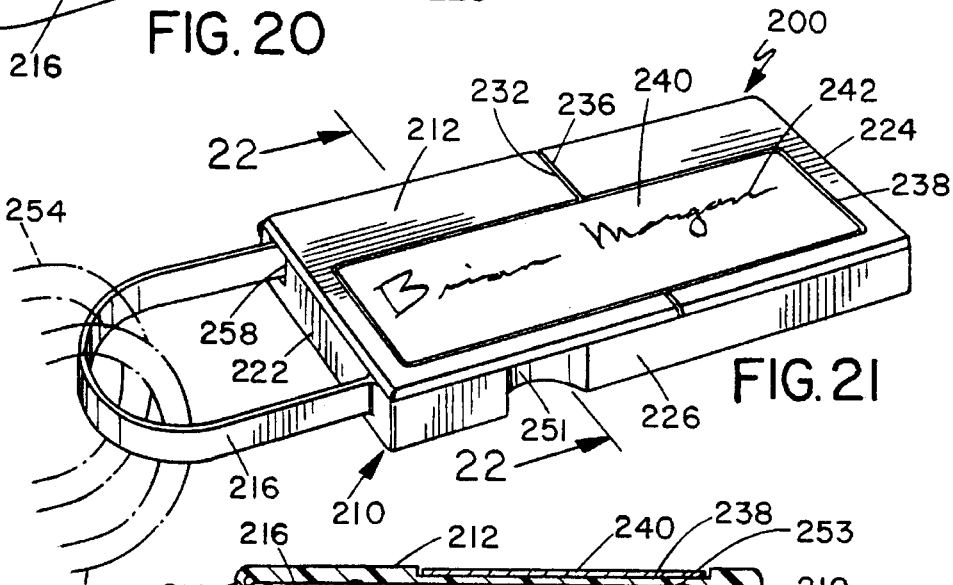

The base unit 210 is a generally flat, rectangular member having a lower wall 220, opposite end walls 222,224, opposite side walls 226,228, and a partial upper wall 230 which forms a continuous, generally flat surface with the cover portion 212 when the cover portion is closed as illustrated in FIG. 21. The cover portion or lid 212 has an inner edge 232 with teeth or serrations 234 which mate with corresponding teeth 235 on mating inner edge 236 of the partial upper wall 230 when the lid is closed. The closed lid and partial upper wall together have an indented area 238 for receiving an adhesive backed paper label 240 or the like for receiving a signature 242, as generally illustrated in FIG. 21.

Figure 22:
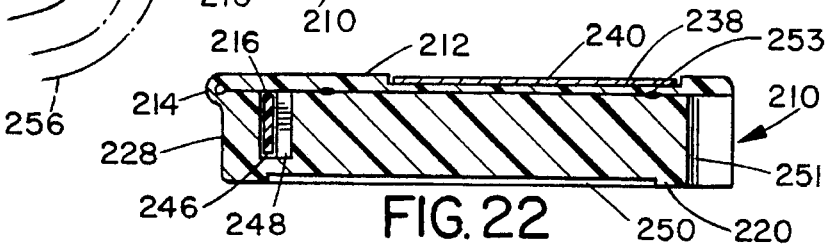
FIG. 22 is a section on the lines 22–22 of FIG. 21.
Figure 23:
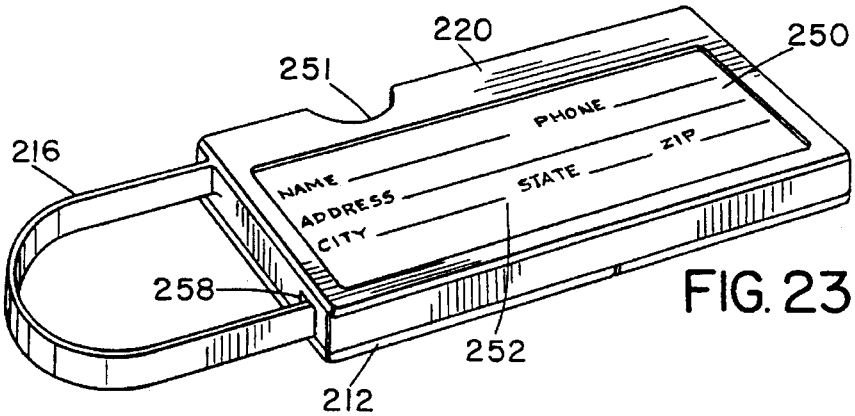
FIG. 23 is a perspective view of the device of FIG. 21 in an inverted position.

The free end 218 of the strap 216 has a series of teeth 244 on one side, and the strap extends from a location on end wall 222 adjacent side wall 226. The base unit has a straight channel or groove 246 extending from end wall 222 at a location adjacent the opposite side wall and underlying the lid 212 when closed. Groove 246 also has a series of spaced teeth 248 on one side wall. Teeth 248 face in the opposite direction to teeth 244 on the strap 216, so that when the strap is inserted into the groove 246 with the lid in the closed position, teeth 244 can pass over the teeth 248 in the insertion direction, but will lock against the teeth on insertion such that the strap 216 cannot be pulled out of the channel when fully inserted, as illustrated in FIGS. 21 and 22.

The lower wall 220 of the base unit preferably also has an indented area 250 for receiving an address label 252 or the like for receiving the user's address. Side wall 226 has an indented, arcuate finger or thumb notch 251 in the region which will underlie lid 212 when the lid is in the closed position, as illustrated in FIG. 21.

Preferably, the unit is supplied to the user with the lid 212 in the closed position and secured to the base unit via a series of ultrasonic weld tabs 253, and a suitable label 240 secured across the closed lid and partial upper wall, but with the strap end 218 free. The user can apply a name and address on label 252, and a signature on label 242. The free end 218 of the strap 216 is then threaded through two eyelets 254,256 or the like on different parts of a container, case or the like to be secured. As in the previous embodiments, the eyelets 254, 256 may comprise existing eyelet or channel units applied to the lid and base of a suitcase, briefcase or the like or to a desk drawer and surrounding frame, for example. The channel units or eyelets may be permanent or may be adhesive backed, plastic eyelets 14 supplied for appropriate application by the user, as discussed above in connection with the previous embodiments. Alternatively, the unit 200 itself may be adhered to one part of a container or the like to be secured, and the strap 216 may then be threaded through an appropriate eyelet on the other part of the container closure. Plastic backed, tear resistant paper eyelets may alternatively be used, as described in my co-pending application filed on even date herewith and entitled "Tamper Indicating Label." Alternatively, the free end 218 may be threaded through a zipper pull tab and a ring at the end of the zipper in the case of a zipper closure, as described above in connection with FIG. 6, or through two zipper pull tabs if present, as illustrated in FIG. 7.

Once the free end 218 of the strap has been threaded through the appropriate eyelets on opposite sides of a container closure or the like in order to secure the container in the closed position, the end 218 is inserted into the channel 246 through open end 258 and pushed in as far as it will go, so that the strap teeth 244 engage over teeth 248 and the strap can no longer be pulled back out of the channel in the opposite direction. The case, container or the like is now secured against others opening the case or container without the user's knowledge. The strap 216 can only be released from the channel by opening the lid 212, which will break off the sonic weld joints and will simultaneously tear through the central region of label 240 and destroy the label. Alternatively, the strap 216 may be cut. In either case, the unit 200 cannot be reused. An unauthorized individual will be unable to duplicate the user's signature 242, even if they have access to an unused unit 200, and will therefore be unable to conceal the fact that the container, case or the like has been opened. Whenever the authorized user wishes to open the case or container, he or she can simply open the lid 212, applying a finger or thumb against the undersurface of the lid 212 in notch 251, releasing the strap 216 so that it can be pulled out of the eyelets. When the container or case is re-closed, a new unit 200 can be used to secure the container or case in the same way, with a signature 242 again applied to label 240 to deter unauthorized opening.

Figure 24:
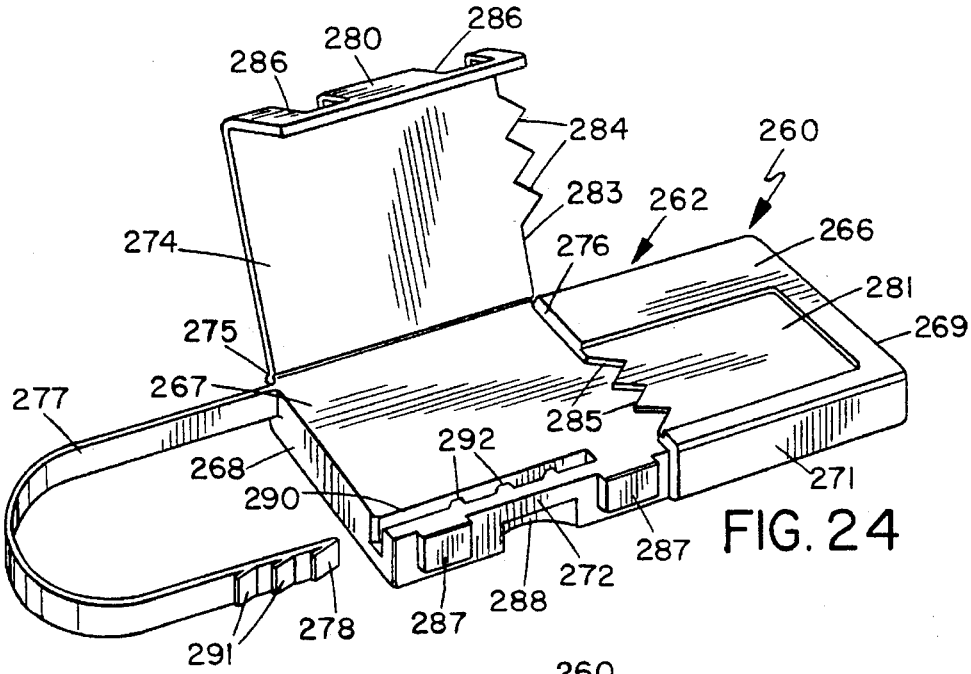
FIG. 24 is a perspective view similar to FIG. 20 illustrating an alternative tamper indicating device which is reusable.
Figure 25:
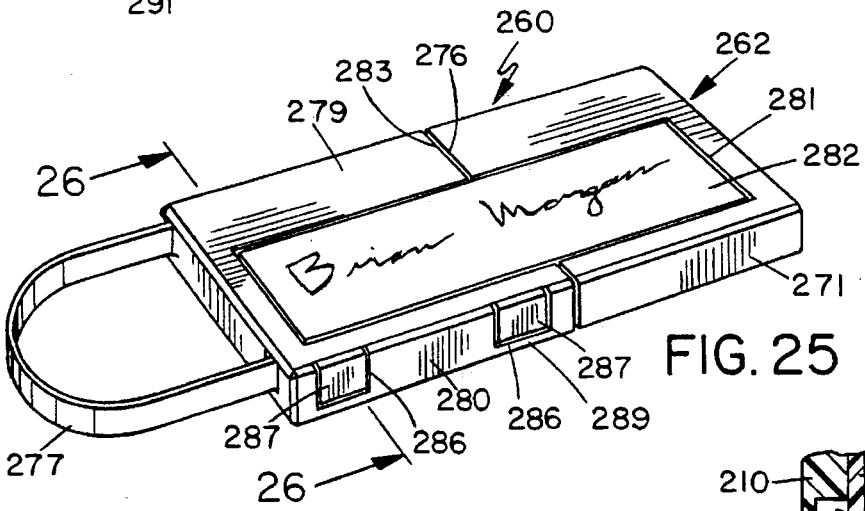
FIG. 25 is a view similar to FIG. 24 illustrating the device in a closed position.
Figure 26:
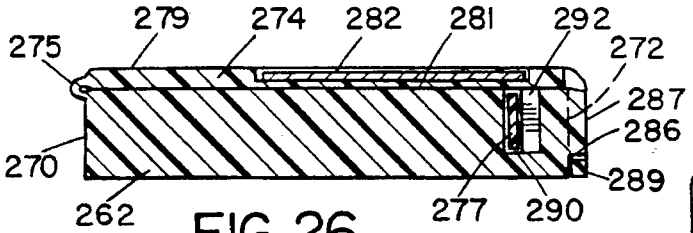
FIG. 26 is a section on the lines 26—26 of FIG. 25.

FIGS. 24–26 illustrate a modified security device 260 which is similar to that of FIGS. 20–23. However, unlike the previous embodiment, device 260 is reusable. As in the previous unit, device 260 is of injection molded plastic material or the like and includes a generally rectangular, thin base unit 262 having a lower wall 264, partial upper wall 266 and upper indented region 267, end walls 268,269, side wall 270, and partial side wall 271 with side indented region 272 aligned with upper indented region 267. A cover portion or lid 274 is hinged to the base unit along living hinge 275 extending along part of side wall 270 up to the inner edge 276 of the partial upper wall. A strap 277 is secured at one end to the end wall 268 and has an opposite, free end 278.

Lid 274 has flat upper portion 279 and a downwardly depending rim or lip 280, and is movable between the open position as illustrated in FIG. 24 in which the indented regions 267 and 272 are uncovered, and the closed position of FIG. 25 in which the lid is closed over indented region 267 and upper portion 279 forms a continuous upper surface with the partial upper wall 266. As in the previous embodiment, the continuous upper surface formed when the lid is closed has an indented, rectangular region 281 for receiving an adhesive label 282, which extends across the junction between the inner edge 283 of lid 274 and the inner edge 276 of the partial upper wall. Also as in the previous embodiment, the mating edges 283,276 have mating teeth or serrations 284,285.

The lid 274 has a pair of square or rectangular latch openings 286 which extend from the edge of upper portion 279 downwardly over rim 280, for latching engagement over corresponding latch bosses or projections 287 projecting outwardly from indented region 272 of the side wall of the base, as best illustrated in FIGS. 25 and 26. A thumb notch 288 is provided in the indented region 272 of the side wall between bosses 287, to allow the rim 280 to be lifted outwardly so that the lower edges 289 of the lip below openings 286 clear the bosses 287 and to allow the lid to be opened. Any alternative latching arrangement may be used between the base and lid to allow the lid to be repeatedly opened and closed by the user.

Unlike the previous embodiment, the strap 275 extends from the hinge side of end wall 268. A locking or strap-trapping channel or groove 290 extends from end wall 268 inwardly across the indented region 267, terminating short of the inner edge 276 of the upper wall. As in the previous embodiment, the strap has spaced, rearwardly directed teeth 291 on one side adjacent free end 278, and the channel 290 has oppositely directed teeth 292 extending from one side wall of the channel, so that the strap can be inserted into the channel but will then be trapped against removal in the opposite direction.

The device will be placed with the lid in the closed position and a label applied across the junction between the lid and upper wall of the base unit, as illustrated in FIG. 25, but with the free end of the strap 277 free from the base unit, as in FIG. 24. The user then applies their signature 294 to label 282. As in the previous embodiment, the free end 278 of the strap is threaded through appropriate eyelets, zipper pull tabs, end rings or the like in order to secure a container, case, briefcase, bag, desk drawer, or the like in the closed position. The free end 278 is then inserted into the open end of channel 290 and pushed in until the teeth 291 engage over corresponding teeth 292 and the strap is trapped in the channel. The container or the like is then secure against opening without the user's knowledge.

If an unauthorized individual should open the lid in order to release the strap 227, the teeth or serrations on the lid will tear through the signed label 282. The only other way to release the strap from the eyelets would be to actually cut the strap. Whichever technique is used, the tampering cannot be concealed, since, in the former case, the individual will be unable to reproduce the user's signature on a new label, and in the latter case, the security device itself is destroyed and cannot be reused. When the authorized user wishes to open the protected container, case or the like, they simply open the lid to release the strap. When the container is re-closed, the user threads the strap back through the eyelets, closes the lid and applies a new label, and inserts the end of the strap back into the locking channel. The user then signs their name on the new label to secure the device against tampering without the user's knowledge.

Figure 28:
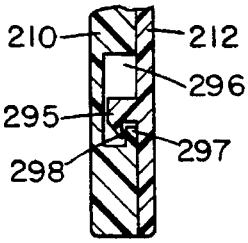
FIG. 28 is a partial cross-section on the lines 28—28 with the device of FIG. 27 in the closed position.
Figure 27:
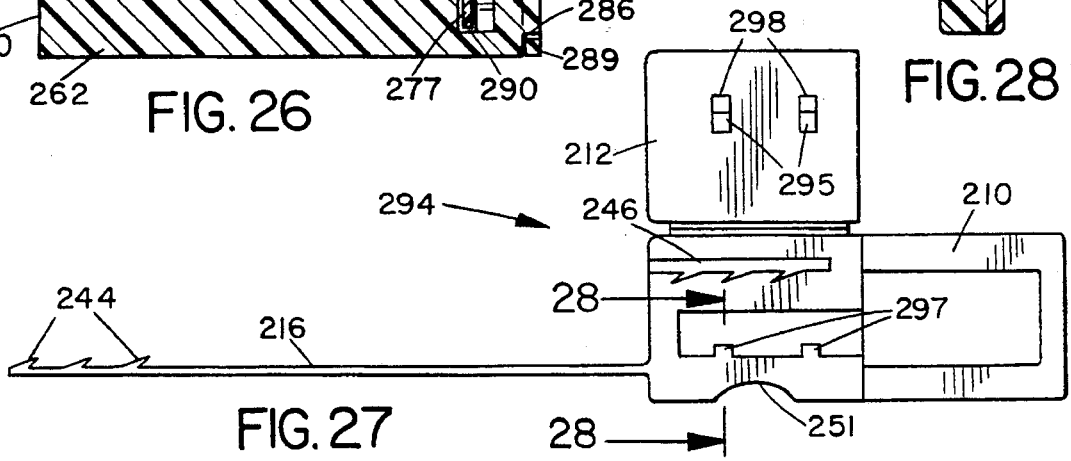
FIG. 27 is a view similar to FIG. 20 illustrating a modification.

FIGS. 27 and 28 illustrate a modification of the disposable tamper indicating device of FIGS. 20–23. In the embodiment of FIGS. 20–23, the base member and lid were secured together by sonic weld tabs 253 which break when the lid is opened to release the strap 216. In the tamper indicating device 294 of FIGS. 27 and 28, the sonic weld tabs are replaced by a pair of snap hooks 295 projecting downwardly from the lid 212 for snap engagement through hook receiving openings 296 in the base 210. The device of FIGS. 27 and 28 is otherwise identical to that of FIGS. 20–23, and like reference numerals have been used for like parts as appropriate.

Each hook receiving opening 296 has a step 297, and the ends 298 of the hooks will snap into engagement beneath the steps 297 when the lid is pressed down so that the hooks are forced through the openings, as illustrated in FIG. 28. Once the hooks are engaged beneath steps 297, the upwardly facing flat face of the hook bears against the downward face of the step to prevent release of the hook, and the lid can only be opened by forcing the lid away from the base with sufficient force to break off the ends 298 of the hooks, so that the device may only be used once. It will be understood that other designs of one-way snap engaging hook and eye formations may be used in place of the hooks 295 and stepped openings 296.

Although the security devices of FIGS. 20–28 involve a lid which opens along a dividing line extending transversely across the upper surface of the rectangular base unit, the lid may alternatively open along a longitudinal dividing line, as in FIG. 11, for example, or along dividing lines extending in other directions.

Each of the tamper indicating devices described above is quick and easy to apply, and is inexpensive. The devices are relatively small and compact, and do not detract from the appearance of the item they are used to secure, such as a suitcase, briefcase or the like. The devices of FIGS. 20–25 can also be used as luggage labels, while simultaneously securing the luggage against opening without the owner's knowledge.

Although some preferred embodiments of the invention have been described above by way of example only, it will be understood by those skilled in the field that modifications may be made to the disclosed embodiments without departing from the scope of the invention, which is defined by the appended claims.

I claim:

1. A tamper indicating security device, comprising:

a base member having a base portion, a cover portion, and a hinge securing the cover portion to the base portion along a hinge line, whereby the cover portion is foldable between an open position in which at least part of the base portion is uncovered and a closed position covering the base portion;

a securing device for securing the cover portion to the base portion in the closed position;

the cover portion having an outer face which faces outwardly in the closed position to form at least part of a label-receiving surface for receiving an adhesive label;

a label secured across said label-receiving surface for receiving personal indicia;

an elongate, flexible strap having a first end secured to said base member and a second, free end for extending through at least one eyelet on a container or case to be protected;

the base member having trapper means for receiving and trapping said free end in the closed position; and the securing device comprising means for preventing release of said free end without tearing said label.

2. The device as claimed in claim 1, wherein the base portion has an upper surface forming part of said label-receiving surface, and an indented region adjacent said upper surface for receiving said cover portion in the closed position whereby the outer surface of said cover portion is aligned with the upper surface of said base portion, the cover portion and upper surface having mating inner edges forming a junction between said upper surface and cover portion in the closed position, and said label extending across said mating inner edges.

3. The device as claimed in claim 2, wherein the mating inner edges of the cover portion and upper surface include mating serrations.

4. The device as claimed in claim 1, wherein the base member has peripheral walls, and a trapper channel extending inwardly from one of the peripheral walls for receiving the free end of said strap, the strap and trapper channel having interengageable mating formations for locking the strap in the channel, the channel comprising said trapper means.

5. The device as claimed in claim 4, wherein the strap has a series of spaced, rearwardly extending teeth at spaced intervals along a portion of the length of the strap extending from said free end, and the channel has a series of spaced teeth for mating engagement with the teeth on the strap, the teeth comprising said interengageable mating formations, the teeth being of predetermined shape for permitting the strap to be inserted in a first direction into said channel and preventing the strap from being withdrawn in a second, opposite direction from said channel.

6. The device as claimed in claim 4, wherein the base portion has an upper portion covered by said cover portion in the closed position, and the channel has an upper opening in the upper portion of said base portion extending along the length of the channel for allowing said strap to be withdrawn upwardly out of the channel when said cover portion is open.

7. The device as claimed in claim 1, wherein said securing device comprises a series of spaced connecting portions between said cover portion and base portion in the closed position, whereby said connecting portions are breakable to allow said cover portion to be opened.

8. The device as claimed in claim 7, wherein said connecting portions comprise ultrasonic weld points.

9. The device as claimed in claim 1, wherein said securing device comprises a first latch part on said cover portion and a second latch part on said base portion for releasable latching engagement with said first latch part in the closed position.

10. The device as claimed in claim 1, wherein said base member is a rectangular member having a lower wall, a partial upper wall extending over part of the area of the lower wall, an indented upper region extending from said partial upper wall over the remainder of the area of the lower wall, opposite end walls, and opposite side walls, said cover portion covering said indented upper region and the outer face of said cover portion being aligned with said upper wall in the closed position, said hinge line extending along at least part of one of the side walls of said base member, and said strap being secured to an end wall of said base member.

11. The device as claimed in claim 10, wherein the base member has an indented, arcuate notch in the side wall opposite to said one side wall and hinge line.

12. The device as claimed in claim 10, including an address label secured to the lower wall of the base member.

13. The device as claimed in claim 1, wherein the base member and strap are formed integrally in one piece.

14. The device as claimed in claim 1, wherein said securing device comprises at least one opening on one of said base and cover portions and a hook on the other portion for snap engagement in said opening when the cover portion is in the closed position.

15. The device as claimed in claim 14, including stop means for preventing release of said hook from said opening after said cover portion has been closed, whereby said hook must be broken to reopen said cover portion.

* * * * *